US007944341B2

(12) United States Patent
Jeon

(10) Patent No.: US 7,944,341 B2
(45) Date of Patent: May 17, 2011

(54) NETWORK SYSTEM USING DC POWER BUS AND AUTO POWER CONTROL METHOD

(75) Inventor: Bum Jin Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 1281 days.

(21) Appl. No.: 11/404,911

(22) Filed: Apr. 17, 2006

(65) Prior Publication Data

US 2006/0232386 A1 Oct. 19, 2006

(30) Foreign Application Priority Data

Apr. 18, 2005 (KR) ..... 10-2005-0031777
Mar. 10, 2006 (KR) ..... 10-2006-0022461

(51) Int. Cl.
*G08B 9/00* (2006.01)

(52) U.S. Cl. ..... 340/286.02; 700/297

(58) Field of Classification Search ..... 370/241; 709/200, 223; 700/19, 297, 286; 307/82, 307/18, 64
See application file for complete search history.

(56) References Cited

U.S. PATENT DOCUMENTS

| | | | | |
|---|---|---|---|---|
| 5,708,820 | A | 1/1998 | Park et al. | |
| 5,901,057 | A * | 5/1999 | Brand et al. | 363/144 |
| 5,930,110 | A * | 7/1999 | Nishigaki et al. | 361/679.43 |
| 6,023,148 | A * | 2/2000 | Pignolet | 320/119 |
| 6,515,840 | B2 * | 2/2003 | Covi et al. | 361/93.1 |
| 6,650,622 | B1 * | 11/2003 | Austerman et al. | 370/241 |
| 6,794,879 | B2 * | 9/2004 | Lawson et al. | 324/509 |
| 6,989,651 | B1 * | 1/2006 | Arikara et al. | 320/116 |
| 6,996,458 | B2 * | 2/2006 | Pincu et al. | 700/297 |
| 7,184,905 | B2 * | 2/2007 | Stefan | 702/63 |
| 7,209,804 | B2 * | 4/2007 | Curt et al. | 700/286 |
| 7,389,318 | B2 * | 6/2008 | Yoshida et al. | 709/200 |
| 2002/0036430 | A1 * | 3/2002 | Welches et al. | 307/18 |
| 2002/0152298 | A1 * | 10/2002 | Kikta et al. | 709/223 |
| 2002/0153778 | A1 * | 10/2002 | Oughton, Jr. | 307/64 |
| 2003/0197428 | A1 * | 10/2003 | Hatton et al. | 307/82 |
| 2005/0015805 | A1 * | 1/2005 | Iwamura | 725/79 |
| 2005/0125083 | A1 * | 6/2005 | Kiko | 700/19 |

FOREIGN PATENT DOCUMENTS

| | | | |
|---|---|---|---|
| JP | 05-211683 | A | 8/1993 |
| KR | 10-1997-0010634 | B1 | 6/1997 |
| KR | 10-1998-038310 | A | 8/1998 |
| KR | 10-2002-0054941 | A | 7/2002 |
| KR | 10-2003-0071903 | A | 9/2003 |

* cited by examiner

*Primary Examiner* — Thong H Vu
(74) *Attorney, Agent, or Firm* — Birch, Stewart, Kolasch & Birch, LLP

(57) ABSTRACT

There is disclosed a home network system using a DC power bus. The network system with a network server and more than one device being connected comprises a main power supply means for converting an AC power into a DC power to supply the DC power to the more than one device; and a DC power bus for providing a supply path of the DC power converted by the main power supply means. Since the DC power is supplied to each device via a power outlet located on the DC power bus, it is possible to supply the power necessary to each device of various kinds included in the network system more efficiently using the main power supply means and the DC power bus. Further, it is possible to prevent the DC power from being supplied to the area to which the power does not need to be supplied, by switching on/off a power breaker within the main power supply means automatically with regards to operation states of the devices located in each area at home, which results in preventing unnecessary power consumption.

9 Claims, 5 Drawing Sheets

FIG 4

Power Management Information

| Area | Object | Status | DC Power Control |
|---|---|---|---|
| Area_A | Device A-1 | Operating | SW_A = On |
| | Device A-2 | Non-Operating | |
| | Sensor A-1 | Detection | |
| Area_B | Device B-1 | *Non-Operating* | *SW_B = Off* |
| | Device B-2 | *Non-Operating* | |
| | Device B-3 | *Non-Operating* | |
| | Sensor B-1 | *No-Detection* | |
| ⋮ | ⋮ | ⋮ | ⋮ |

NETWORK SYSTEM USING DC POWER BUS AND AUTO POWER CONTROL METHOD

BACKGROUND OF THE INVENTION

1. Field of the Invention

The present invention relates to a network system using a DC power bus, more particularly to a network system using a DC power bus and an auto power control method in which a power necessary to each device of various kinds included in the network system located at home can be supplied and controlled more efficiently using a DC power bus.

2. Description of the Related Art

Generally, the network system located at home, for example a home network system has devices such as various home appliances within home and a variety of sensors to be connected with one another, in order to enable users to enjoy best life service easily and safely at home or out-of-home. For example, as shown in FIG. 1, in the general network system is located a network server 10.

Meanwhile, the network server 10 can be connected with a video camera 20, a DVD player 21, and a digital television 22 located at home via a power line or RF communication, and also connected with a telephone 30, an actuator 31 and a monitoring sensor 40 and a door lock 41 so that it may perform interface operations to transmit/receive signals with each of the devices being connected.

Further, the network server 10 comprises direct current (DC)/direct current (DC) converters 100, 101, 102 for converting DC power converted from the AC power into a prescribed DC power necessary to the video camera 20, the DVD player 21, the digital television 22 and the like respectively, as shown in FIG. 1.

And, the telephone 30 and the actuator 31 comprises AC/DC converters 300, 310 for converting the AC power into a prescribed DC power necessary to corresponding device, and the monitoring sensor 40 and the door lock 41 use a battery power to enable an always-on power even in power-off.

However, because the DC power converted by the DC/DC converter within the network server 10 is supplied to the devices of various kinds included in the network system, for example, video camera, DVD player, and digital television, and the DC power converted using separate AC/DC converter is supplied to the telephone and the actuator, there are problems in which power wiring of the network system is complicate, and power consumption is unnecessarily high.

SUMMARY OF THE INVENTION

Therefore, the present invention is devised in consideration of the aforementioned situation, and it is an object of the invention to provide a network system which comprises a main power supply means for converting an AC power into a DC power to supply the DC power to the more than one device; and a DC power bus for providing a supply path of the DC power converted by the main power supply means, thereby to supply the power necessary to the network system efficiently.

Further, the present invention is to provide an auto power control method in the network system using the DC power bus in which a network server monitors operation states of the devices which are classified and managed for each area, and automatically switches off a power breaker within the main power supply means supplying the DC power to any area if the power is determined not to need to be supplied to the area, thereby to prevent unnecessary power consumption.

In order to achieve the objects, the network system using the DC power bus according to the present invention comprises a main power supply means for converting an AC power into a DC power to supply the DC power to the more than one device; and a DC power bus for providing a supply path of the DC power converted by the main power supply means.

Further, the network system using the DC power bus according to the present invention comprises a main power supply means for converting an AC power into a DC power to provide the DC power to the more than one device; and a DC power bus for providing a supply path of the DC power converted by the main power supply means, wherein the main power supply means comprises more than one power breaker for allowing the DC power to be provided or interrupted to each area; and the network server controls on/off operation of the power breakers by confirming a current state of the more than one device.

Further, an auto power control method in a network system using a DC power bus according to the present invention comprises monitoring operation states of devices that are classified and managed for each area in the network server if an auto power control operation is performed in the network system using the DC power bus; and automatically turning off a power breaker within the main power supply means which supplies the DC power to any area, if a power off condition is identified for the area as a result of the monitoring.

BRIEF DESCRIPTION OF THE DRAWINGS

FIG. 4 illustrates an embodiment of power management information which is stored and managed by the present invention.

DETAILED DESCRIPTION OF PREFFERRED EMBODIMENTS

A preferable embodiment of the network system using the DC power bus and the auto power control method according to the present invention will be now described referring to accompanying drawings.

Figure 2:
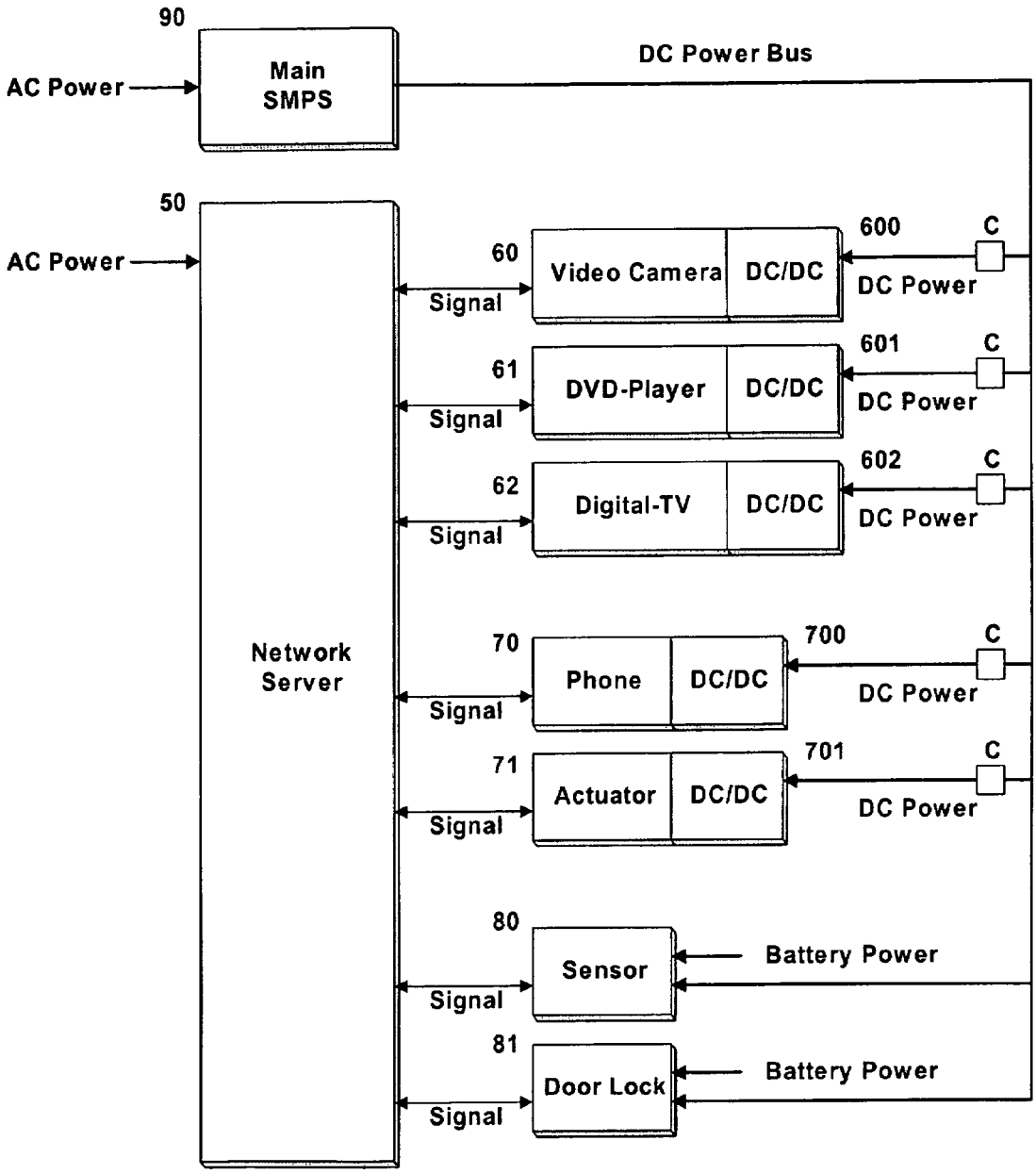
FIG. 2 illustrates a structure of network system using a DC power bus according to a first embodiment of the present invention.

FIG. 2 illustrates a structure of network system using the DC power bus according to a first embodiment of the present invention. For example, a network server 50 located at home can be connected to a video camera 60, a DVD player 61, a digital television 62 and the like.

Further, the network server 50 can be connected to a telephone 70, an actuator 71, a monitoring sensor 80, a door lock 81 and the like, and performs a series of interface operations to transmit/receive signals with each of the devices being connected.

Figure 1:
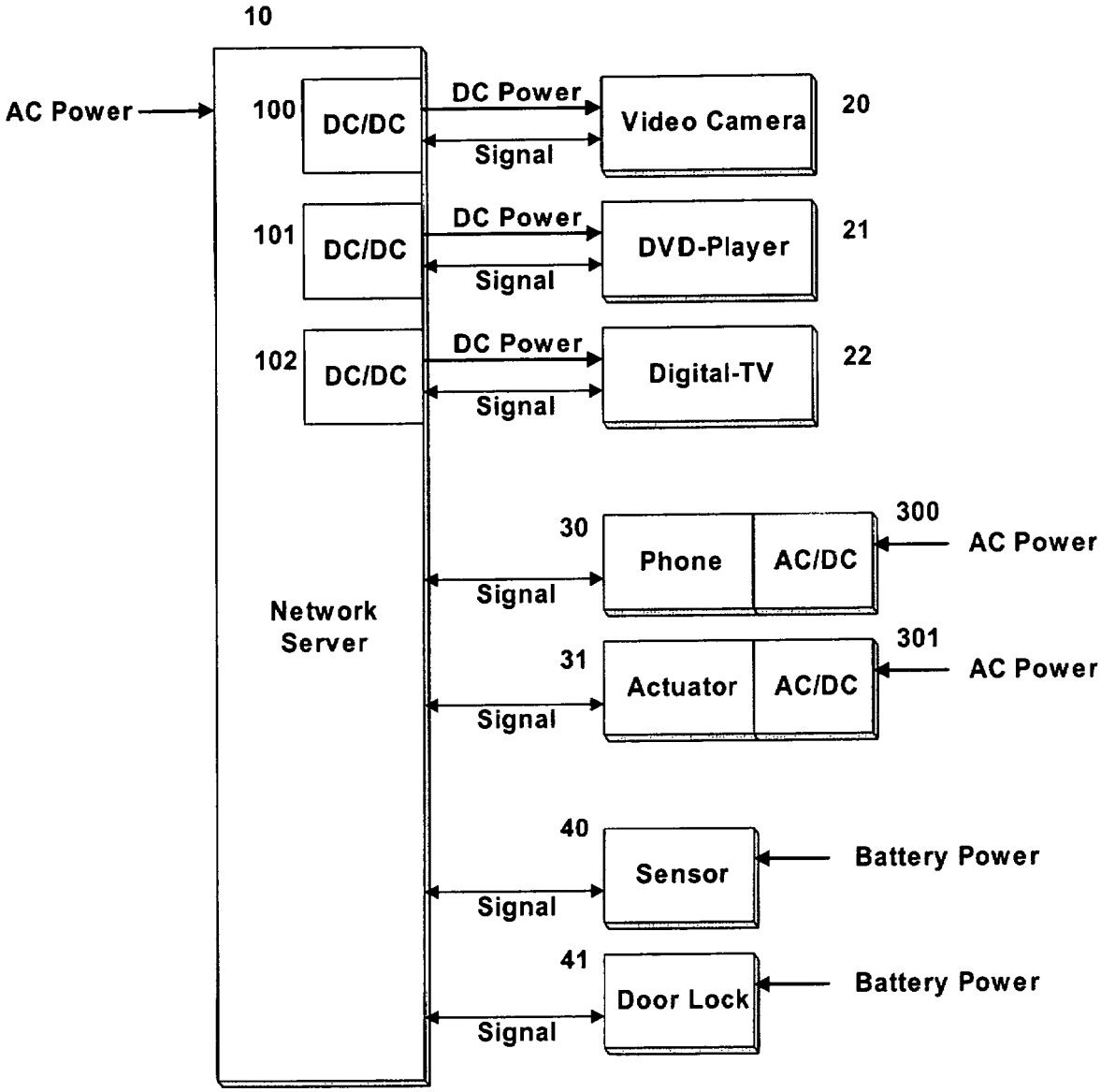
FIG. 1 illustrates a structure of general network system.

In the network server 50, rather than including the DC/DC converters 100, 101, 101 shown in FIG. 1, one main power supply means (SMPS) 90 is additionally located in the network system for supplying the DC power necessary to each device.

And, within the network system is located a DC power bus for providing a supply path of the DC power converted by the main power supply means 90, and on the DC power bus is located a plurality of power outlets C.

The devices to which the DC power is supplied via the power outlets, for example, the video camera 60, the DVD player 61, the digital television 62, the telephone 70, and the actuator 71 comprise or are connected to DC/DC converters 600, 601, 602, 700, 701 for converting the DC power into a prescribed DC power suitable for the corresponding device.

Consequently, the main power supply means 90 converts the AC power into the DC power, the converted DC power is supplied to each power outlet via the DC power bus, and the DC power is converted into the prescribed DC power by the DC/DC converter to be supplied if the user connects each device to the power outlets.

Since the monitoring sensor 80 and the door lock 81 must be an always-on power even in power-off, separate battery powers are used along with the DC power. Further, the network server 50 uses the AC power separately from DC power converted by the main power supply means, since it needs relatively higher power that the devices.

Consequently, since the network server 50 do not necessarily include a plurality of DC/DC converters, and the DC power converted by the main power supply means 90 can be supplied to each device using the DC power bus, efficiencies of power wiring and power supply within the network system are improved.

Figure 3:
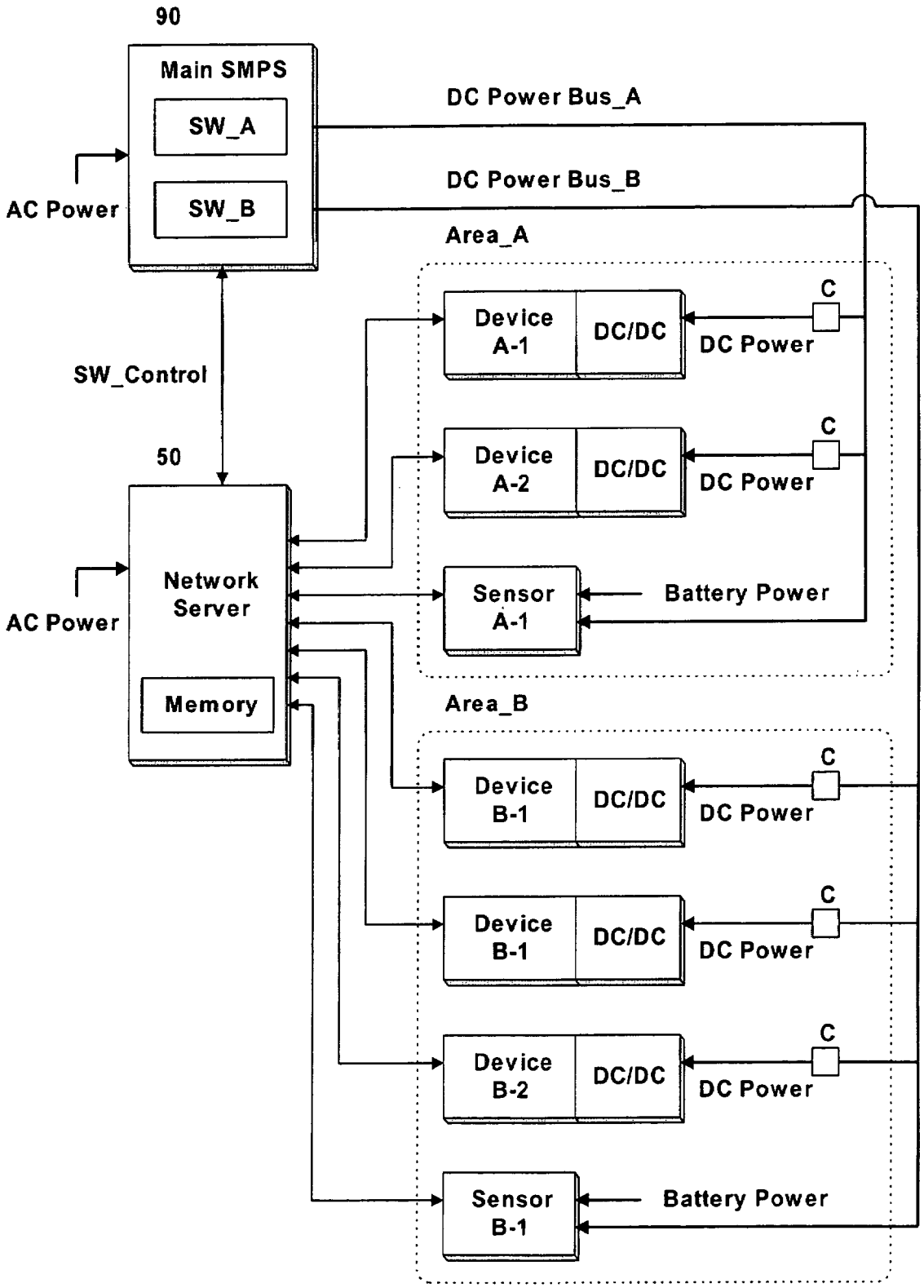
FIG. 3 illustrates a structure of network system using a DC power bus according to a second embodiment of the present invention.

FIG. 3 illustrates a structure of a network system using the DC power bus according to a second embodiment of the present invention. For example, in the main power supply means 90 are located a plurality of the power breakers (i.e., SW_A, SW_B), and the DC power is supplied or interrupted selectively via each power breaker.

Meanwhile, the main power supply means 90 turns on/off each power breaker via interface with the network server 50. After dividing a living room, a bathroom, a library, a front door and the like into different areas, the network server 50 classifies and manages multiple devices and sensors located in each of the areas as a one group.

For example, providing that 2 devices A-1, A-2 and a single sensor A-1 are located within the area A (Area_A) which is the bedroom at home and 3 devices B-1, B-2, B-3 and a single sensor B-1 are located within the B area (Area_B) which is the living room at home, the network server 50 classifies and manages the devices and sensor located in each of the A area and the B area as a one group.

As shown in FIG. 4, it is possible to store and manage power management information for the area A, by combining current state information for the 2 devices A-1, A-2 and the single sensor A-1 located in the area A with on/off state information for an power breaker A (SW_A) within the main power supply means 90 which supplies or interrupts the DC power to the area A.

Further, it is possible to store and manage the power management information for the area B, by combining current state information for the 3 devices B-1, B-2, B-3 and the single sensor B-1 located in the area B with on/off state information for power breaker B (SW_B) within the main power supply means 90 that supplies or interrupts the DC power to the area B.

If the power is determined not to need to be supplied to the corresponding area by confirming the current state of the devices and the power breaker which are classified and managed for each area, the main power supply means 90 will be operatively controlled to turn off the corresponding power breaker automatically.

For example, as shown in FIG. 4, if any one of 2 devices A-1, A-2 located in the area A is in an operating state or the single sensor A-1 is in a detection state, the DC power is allowed to be normally supplied to the area A by turning on the power breaker A (SW_A) automatically.

Meanwhile, if all of the 3 devices B-1, B-2, B-3 located in the area B are in a non-operating state and the single sensor B-1 is in a no-detection state, an auto power control operation is performed which prevents the DC power from being unnecessarily supplied to the area B by turning off the power breaker B (SW_B) automatically.

Figure 5:
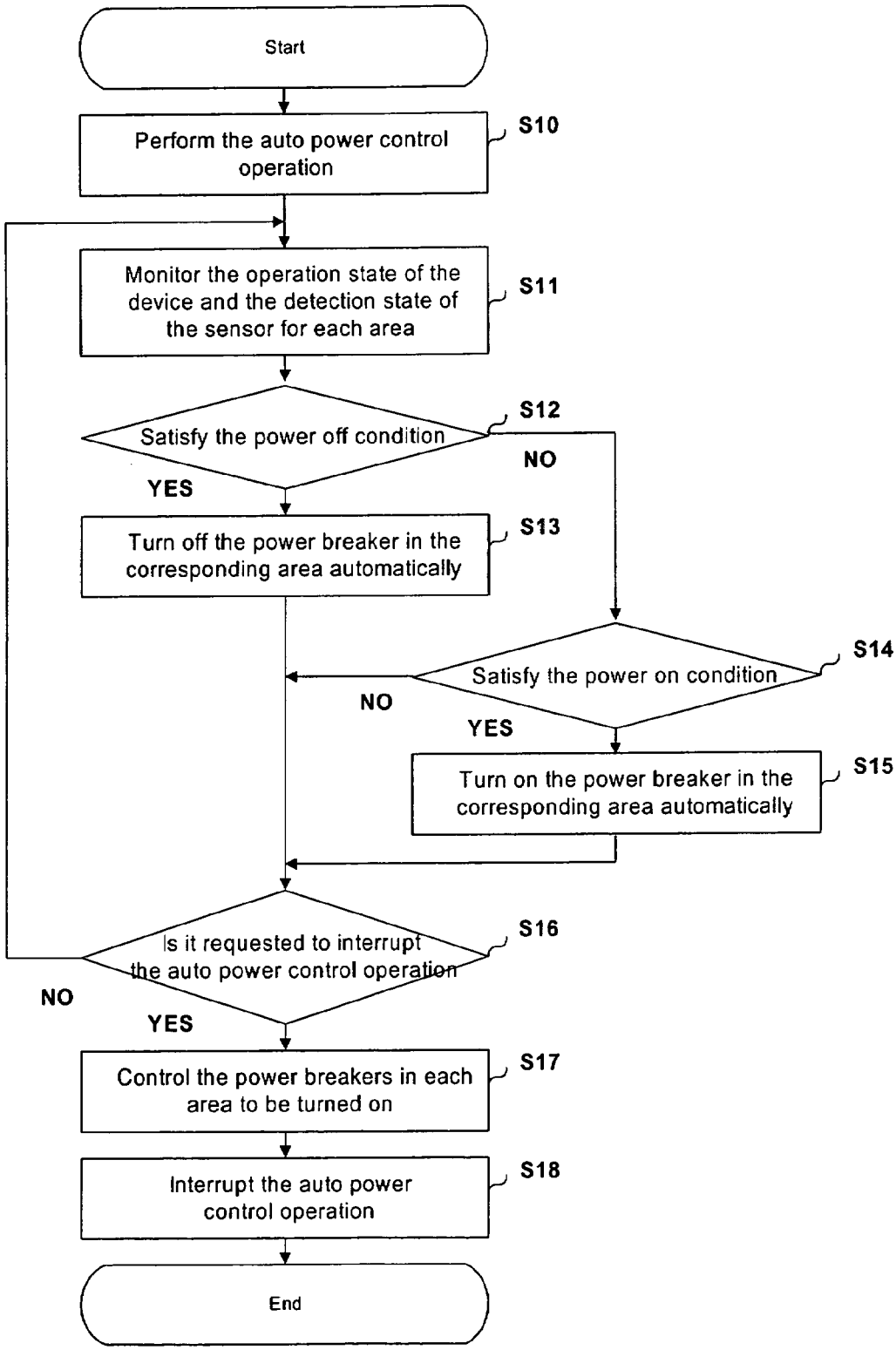
FIG. 5 illustrates an operational flow chart of an auto power control method according to the present invention.

FIG. 5 illustrates an operational flow chart of the auto power control method according to the present invention. If the auto power control operation is performed through user requests at the network server 50 (S10), the operation state of the devices and the detection state of the sensor which are located in each area, such as for example, a living room, bedroom, library, front door are monitored (S11).

As a result of the monitoring, if any area is determined to satisfy a power off condition predetermined (S12), the auto power control operation is performed which automatically turns off the power breaker supplying the DC power to the corresponding area from amongst the plurality of power breakers included in the main power supply means 90 (S13).

For example, if all of the devices B-1, B-2, B-3 located in the area B corresponding to the living room at home is in the non-operating state, and at the same time the single sensor B-1 is in the no-detection state, the network server 50 determines them as the power off condition for the area B, and then automatically switches off the power breaker B (SW_B) that provides the DC power to the area B.

Meanwhile, as a result of the monitoring, if it any area is determined to satisfy a power on condition predetermined (S14), the auto control operation is performed which automatically turns on the power breaker supplying the DC power to the corresponding area from amongst the plurality of power breakers included in the main power supply means 90 (S15).

For example, if at least one of devices A-1, A-2 located in the area A corresponding to the bedroom at home is in the operating state, and at the same time the single sensor A-1 is in the detection state, the network server 50 determines them as the power on condition for the area A, and then automatically switches on the power breaker A (SW_A) that provides the DC power to the area A.

Further, if it is requested to interrupt the auto power control operation by the user (S16), the network server 50 controls all of the power breakers included in the main power supply means 90 to be turned on (S17), and then interrupts the auto power control operation (S18). Therefore, it is possible to prevent the DC power from being supplied to the area to which the power does not need to be supplied, which results in preventing unnecessary power consumption.

As describe above, while the present invention has been disclosed for the purpose of illustration with reference to the aforementioned preferred embodiment, it will be understood by those skilled in the art that the foregoing embodiment can be improved, modified, substituted or added in a variety of ways without departing from the technical spirit and scope of the invention as defined by the appended claims.

What is claimed is:

1. A network system with a network server and more than one device being connected comprising:

a main power supply means for converting an AC power into a DC power to provide the DC power to the more than one device; and a DC power bus for providing a supply path of the DC power converted by the main power supply means, wherein the main power supply means comprises more than one power breaker for allowing the DC power to be provided or interrupted to each area;

the network server controls on/off operation of the power breakers by confirming a current state of the more than one device; and wherein the network server classifies a location corresponding to at least one of a living room, a bedroom, a library, and a front door at home as a one area, combines state information of the device located in the area with a state information of the power breaker that provides or interrupts the power to the area, and stores and manages them as power management information.

2. The network system of claim 1 wherein the network server confirms current state of the devices and the power breaker which are classified and managed for each area and automatically turns off the corresponding power breaker if the power is determined not to need to be supplied to the corresponding area.

3. The network system of claim 1 wherein the network server confirms current states of the devices and the power breakers which are classified and managed for each area, and automatically turns on the corresponding power breaker if the power is determined to need to be supplied to the corresponding area.

4. An autopower control method in a network system using a DC power bus comprising:

monitoring operation states of devices that are classified and managed for each area in the network server if an auto power control operation is performed in the network system using the DC power bus;

automatically turning off a power breaker within the main power supply means which supplies the DC power to any area, if a power off condition is identified for the area as a result of the monitoring; and wherein the network server classifies a location corresponding to at least one of a living room, a bedroom, a library, and a front door at home as a one area, combines state information of the device located in the area with state information of the power breaker that provides or interrupts the power to the area, and stores and manages them as power management information.

5. The auto power control method of claim 4 wherein the network server monitors operation states of the devices and a detection state of the sensor which are classified and managed for each area.

6. The auto power control method of claim 5 wherein the power off condition is that all the devices and the sensor located in the corresponding area are in a non-operation state and a no-detection state respectively.

7. The auto power control method of claim 5 further comprising:

interrupting the auto power control operation after switching on all power breakers within the main power supply means if it is requested to interrupt the auto power control operation.

8. The auto power control method of claim 4 further comprising:

automatically turning on the power breaker within the main power supply means that supplies the DC power to any area, if the power on condition is identified for the area as a result of the monitoring.

9. The auto power control method of claim 8 wherein the power on condition is that at least one of the devices located in the corresponding area is in an operation state or the sensor is in a detection state.

* * * * *